US007759643B2

(12) United States Patent
Lloyd et al.

(10) Patent No.: US 7,759,643 B2
(45) Date of Patent: Jul. 20, 2010

(54) SINGLE ELECTRODE CORONA DISCHARGE ELECTROCHEMICAL/ELECTROSPRAY IONIZATION

(75) Inventors: John R. Lloyd, Germantown, MD (US); Sonja Hess, Arcadia, CA (US)

(73) Assignees: California Institute of Technology, Pasadena, CA (US); The United States of America, Washington, DC (US)

( * ) Notice: Subject to any disclaimer, the term of this patent is extended or adjusted under 35 U.S.C. 154(b) by 308 days.

(21) Appl. No.: 12/038,276

(22) Filed: Feb. 27, 2008

(65) Prior Publication Data

US 2008/0203303 A1 Aug. 28, 2008

Related U.S. Application Data

(60) Provisional application No. 60/903,772, filed on Feb. 27, 2007.

(51) Int. Cl.
*H01T 19/04* (2006.01)
*H01J 49/00* (2006.01)
*H01J 27/00* (2006.01)

(52) U.S. Cl. ..... 250/324; 250/288; 250/423 R; 250/424; 250/425; 422/68.1; 422/100

(58) Field of Classification Search ..... 250/281, 250/282, 288, 324, 423 R, 424, 425, 492.3, 250/493.1; 422/68.1, 100
See application file for complete search history.

(56) References Cited

U.S. PATENT DOCUMENTS

| | | | | |
|---|---|---|---|---|
| 4,719,349 | A | 1/1988 | Phillips et al. | |
| 5,393,975 | A | 2/1995 | Hail et al. | |
| 5,879,949 | A | 3/1999 | Cole et al. | |
| 6,677,593 | B1 | 1/2004 | Van Berkel | |
| 6,784,439 | B2 | 8/2004 | Van Berkel | |
| 6,794,646 | B2 * | 9/2004 | Tong et al. | 250/288 |
| 6,949,739 | B2 * | 9/2005 | Franzen | 250/288 |
| 7,256,396 | B2 | 8/2007 | Reilly | |
| 2003/0062475 | A1 | 4/2003 | Karst et al. | |
| 2004/0099803 | A1 * | 5/2004 | Tong et al. | 250/288 |
| 2004/0245457 | A1 | 12/2004 | Granger et al. | |

(Continued)

FOREIGN PATENT DOCUMENTS

WO WO 01/94931 A2 12/2001

OTHER PUBLICATIONS

Karst, Electrochemistry/Mass Spectrometry (EC/MS)—A New Tool to Study Drug Metabolism and Reaction Mechanisms, Angew. Chem. Int. Ed., 2004, vol. 43, 2476-2478.

(Continued)

*Primary Examiner*—Bernard E Souw
(74) *Attorney, Agent, or Firm*—Kauth, Pomeroy, Peck & Bailey LLP

(57) ABSTRACT

A single electrode electrochemical/electrospray ionization source using a corona discharge and a method of analyzing a sample using a corona discharge single electrode electrochemical/electrospray ionization source are provided. In the corona discharge single electrode electrochemical/electrospray ionization technique electrons are removed from the metal tip of the device through gases present in the electrospray ion source resulting in electrochemical ionization of the sample of interest. The resulting odd electron sample cation (positive ion mode) or anion (negative ion mode) can then be analyzed by an appropriate technique, such as, for example, a mass spectrometer.

38 Claims, 15 Drawing Sheets

U.S. PATENT DOCUMENTS

| | | | | |
|---|---|---|---|---|
| 2005/0148838 | A1 | 7/2005 | Gamache et al. | |
| 2007/0007448 | A1 | 1/2007 | Wang | |
| 2008/0203303 | A1 * | 8/2008 | Lloyd et al. | 250/324 |

OTHER PUBLICATIONS

Van Berkel et al., Expanded Electrochemical Capabilities of the Electrospray Ion Source Using Porous Flow-Through Electrodes as the Upstream Ground and Emitter High-Voltage Contact, Analytical Chemistry, 2005, vol. 77, No. 24, 8041-8049.

Williams et al., Ratiometric analysis of the ferrocene boronate esters of 2- and 4-hydroxyestradiol by tandem electrospray mass spectrometry, Rapid Commun. Mass Spectrom, 2001, vol. 15, 182-186.

Williams et al., Analysis of neutral isomeric low molecular weight carbohydrates using ferrocenyl boronate derivatization and tandem electrospray mass spectrometry, Rapid Commun. Mass Spectrom, 2000, vol. 14, 2083-2091.

Moon et al., Electrophysicochemical Characteristics of a Waterpen Point Corona Discharge, IEEE Transactions of Industry Applications, Nov./Dec. 1998, vol. 34, No. 6, 1212-1217.

Van Berkel et al., Derivatization for electrospray ionization-mass spectrometry. 4. Alkenes and alkynes, Rapid Commun. Mass Spectrom, 2000, vol. 14, 849-858.

Van Berkel et al., Using the Electrochemistry Electro Spray Ion Source, Analytical Chemistry, Aug. 2007, pp. 5511-5520.

Kertesz et al., Expanded Use of a Battery-Powered Two-Electrode Emitter Cell for Electrospray Mass Spectrometry, J. Am. Soc. Mass Spectrom., 2006, vol. 17, 953-961.

Uhm et al., An analytical theory of corona discharge plasmas, Phys. Plasmas, Sep. 1997, vol. 4, No. 9, pp. 3117-3128.

Preece et al., The Analysis of Organometallic Compounds Using Electrospray Ionization Mass Spectrometry, Micromass MS Technologies, Oct. 2002, 6 pgs.

Pekarek et al., Hollow Needle-to-plate Electrical Discharge at Atmospheric Pressure, Source and date unknown, 8 pgs.

Seiwert et al., Analysis of cysteine-containing proteins using precolumn derivatization with N-(2-ferroceneethyl)maleimide and liquid chromatography/electrochemistry/mass spectrometry, Anal. Bioanal. Chem., 2007, 10 pgs.

Li et al., Mapping of Potential Gradients within the Electrospray Emitter, Anal. Chem., 2003, vol. 75, 6987-6994.

Pekarek et al., Ozone and Nitrogen Oxides Generation In Gas Flow Enhanced Hollow Needle To Plate Discharge In Air, Czech Technical University in Prague, FEE, Technicka 2, 166 27, Prague 6, Czech Republic, 9 pgs.

Singh et al., Liquid Chromatography/Electron Capture Atmospheric Pressure Chemical Ionization/Mass Spectrometry: Analysis of Pentafluorobenzyl Derivatives of Biomolecules and Drugs in the Attomole Range, Analytical Chemistry, 2000, vol. 72, No. 14, pp. 3007-3013.

Fernandez De La Mora et al., Special Feature: Discussion Electrochemical processes in electrospray ionization mass spectrometry, J. Mass Spectrom, 2000, vol. 35, 939-952.

* cited by examiner $$M - e^- \rightarrow G^- + hv + M+$$

$$Fc + M+ \rightarrow Fc+ + M$$

A

B

I

II

III

SINGLE ELECTRODE CORONA DISCHARGE ELECTROCHEMICAL/ELECTROSPRAY IONIZATION

CROSS-REFERENCE TO RELATED APPLICATIONS

The current application claims priority to U.S. Provisional Application No. 60/903,772, filed Feb. 27, 2007, the disclosure of which is incorporated herein by reference.

STATEMENT OF FEDERAL RIGHTS

The U.S. Government has certain rights in this invention pursuant to funding from the National Institute of Diabetes, Digestive and Kidney Diseases.

FIELD OF THE INVENTION

The current invention is directed to a method and apparatus for conducting electrochemical/electrospray ionization; and more particularly to a method and apparatus for ionization that utilizes corona discharge single electrode electrochemical/electrospray ionization.

BACKGROUND OF THE INVENTION

There have been a number of reports documenting electrochemical (EC) aspects of electrospray ionization mass spectrometry (ESI). For example, the EC process inherent in the normal operation of an electrospray (ES) ion source is well documented. (See, e.g., Van Berkel, G. J., The Electrolytic Nature of Electrospray, Chap. II. In *Electrospray Ionization Mass Spectrometry*; Cole, R. B. Ed.; Wiley: New York, 1997, pp 65-105; Kebarle, P. & Ho, Y., "The Electrolytic Nature of Electrospray, Chap. I. In *Electrospray Ionization Mass Spectrometry*; Cole, R. B., Ed.; Wiley: New York, 1997, pp 3-63; Li, Y., et al., Anal. Chem. 2003, 75, 6987-6994; and X. Van Berkel, G. J., Kertesz, Anal. Chem. 2007, 5511-5520, the disclosures of which are each incorporated herein by reference.) To summarize, it has long been known that a metal electrospray capillary, operating at high voltage, can function as an electrode where electrochemical one-electron transfer reactions can occur. Moreover, under specific conditions, and with specific compounds, these electrochemical reactions can be a significant part of the ES spectrum, but under normal operating conditions the EC process does not result in significant ion intensity. (See, e.g., De la Mora, J. F., et al., J. Mass Spectrom. 2000, 35, 939-952; Williams, D. & Young, M. K. Rapid Commun. Mass Spectrom. 2000, 14, 2083-2091; and Williams, D., et al., Rapid Commun. Mass Spectrom. 2000, 15, 182-186, the disclosures of which are incorporated herein by reference.) An example of the experimental conditions required to obtain meaningful EC results with an ES ion source are reported by Van Berkel et al., where first cis-diols were derivatized with ferrocene boronic acid and then the subsequently formed electrochemically active derivative was eluted into the ES ion source with a solvent system containing 100 μM lithium trifluoromethane sulfonate. (See, Van Berkel, G. J., et al., Rapid Commun. Mass Spectrom. 2000, 14, 849-858, the disclosure of which is incorporated herein by reference.) In this example, the role of the lithium trifluoromethane sulfonate is to negate ion suppression effects observed with EC under ES conditions.

Other approaches to amplify the electrochemically generated ion signal, and to gain more control over the EC process, involve hardware modifications to the basic ES design. (See, e.g., Kertesz, V. & Van Berkel, G. J., J. Am. Soc. Mass Spectrom. 2006, 17, 953-961; and Karst, U., Angew. Chem. Int. Ed. 2004, 43, 2476-2478, the disclosures of which are incorporated herein by reference.) For example, Van Berkel incorporates a porous flow-through electrode to extend the capabilities of the EC inherent in the ES process. (See, Van Berkel, G. J., et al., Anal. Chem. 2005, 77, 8041-8049, the disclosure of which is incorporated herein by reference.) Another approach to enhancing EC capabilities to ES has been to add an EC cell in-line, upstream of the ES ion source. For example, Seiwart and Karst have recently reported an application of such an in-line EC/ESI-RP-HPLC-MS. (Seiwert, B. & Karst, U., Anal. Bioanal. Chem. 2007, 17 Apr. Epub, the disclosure of which is incorporated herein by reference.) The advantage of such an in-line EC cell is that the electrochemical process can be better controlled. The disadvantage of the in-line EC cell technique is the requirement of additional complicated hardware, it is sensitive, but it can often produce unwanted reactions.

The result is that despite the research conducted on EC/ESI by researchers over the years there are no real practical applications of this phenomenon. The reason for the slow pace of development results from the shortcomings discussed above, namely, the requirement in conventional systems of a separate, unique ion source to affect ECI, and a lack of sensitivity in these conventional ESI ion sources. In fact, so poor have the results been that there has not been a single direct study of the actual sensitivity of EC/ESI MS. Finally, underlying both of the above limitations is that current EC/ESI technology lacks an effective means to remove electrons and keep them removed from the eluting sample medium. Accordingly, an improved EC/ESI methodology is needed to provide a simple, high sensitivity chemical analytical technique

SUMMARY OF THE INVENTION

The current invention is directed to a method and apparatus for conducting electrospray ionization with a wide-variety of molecules and detectors that utilizes a single electrode corona discharge electrochemical/electrospray ionization technique.

BRIEF DESCRIPTION OF THE DRAWINGS

The description will be more fully understood with reference to the following figures and data graphs, which are presented as exemplary embodiments of the invention and should not be construed as a complete recitation of the scope of the invention, wherein.

DETAILED DESCRIPTION OF THE INVENTION

Figure 1:
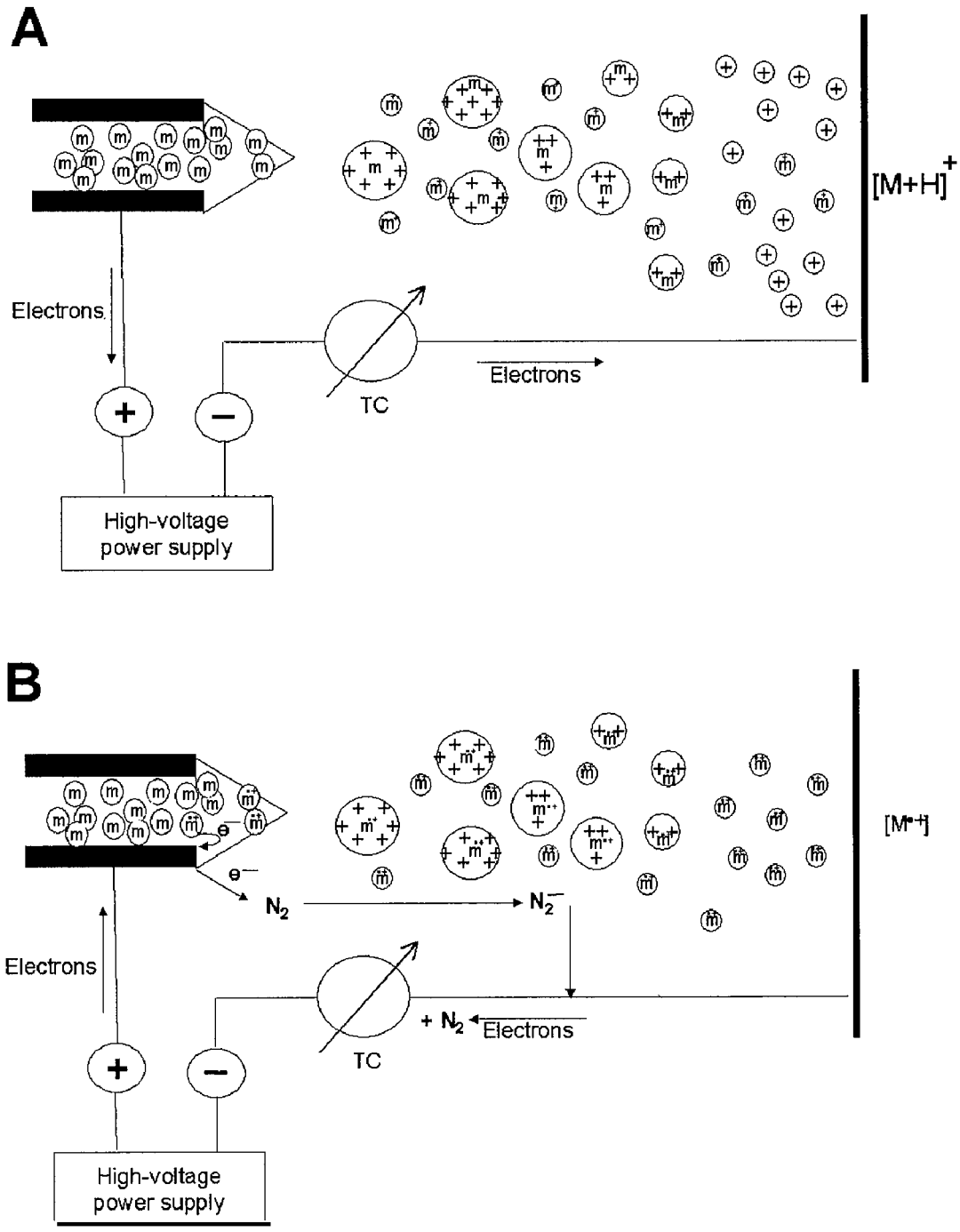
FIGS. 1*a* and 1*b* show schematic diagrams providing a comparison of (A) conventional electrospray ionization; and (B) the electrochemical/electrospray ionization of the current invention.

The current invention is directed to a process and device for providing an efficient, robust system capable of performing electrochemical/electrospray ionization using a stable corona discharge. The invention utilizes the corona discharge (CD) phenomenon to effectively ionize the material of the capillary of the electrospray (ESI) ion source. The electrons are removed or added from/to the metal tip of the device through gases present in the ESI ion source resulting in electrochemical ionization (ECI) of the sample of interest. The resulting odd electron sample ion is then analyzed by an appropriate technique, such as, for example, a mass spectrometer. Advantageously, once the ion is created via CD, unlike in prior art technologies, the charge cannot return and neutralize the sample ion. Using the current system it is also possible to couple electrochemical detection with other analytical techniques, such as mass spectroscopy providing an integrated technique with a level of sensitivity unmatched by current techniques.

Before discussing the details of the current invention, it is important to provide a description of the CD phenomenon and the role CD plays in the current device and has played traditionally in electrospray techniques. Corona discharge is a well-understood process that has been the subject of a great deal of research involving the formation and subsequent reactivity of gas-phase plasmas. For ion sources used in mass spectroscopy the most common usage for CD is the plasma generated at the tip of an atmospheric pressure ionization (APCI) needle. In such a technique kilovolts of voltage are applied to a sharp needle in the presence of an atmosphere of gas. When the voltage is applied the surrounding gas ionizes to create a plasma full of reactive $$G \xrightarrow[e^-]{} G^{-*}$$

$$G^{-*} \xrightarrow[\text{Plasma}]{M} M^- + M^+ + e^- + h\nu$$

gas-phase ionic species, in accordance with the reaction schematic below. The reactive species formed by this process then can react with other gas neutrals in ion molecule reactions to create secondary ions that can be analyzed by mass spectrometers.

CD has also been observed under ES conditions, mostly as an unwanted side-effect at the tip of the metal ES capillary. In two of the reported cases the observed discharge resulted in atmospheric pressure chemical ionization (APCI) conditions where the discharge plasma formed product ions resulting from ion-molecule reactions. (See, e.g., Van Berkel, G. J., The Electrolytic Nature of Electrospray, Chap. II. In *Electrospray Ionization Mass Spectrometry*; Cole, R. B., Ed.; Wiley: New York, 1997, p 98; and Bruins, A. P., ESI Source Design and Dynamic Range Considerations, Chap. III. In *Electrospray Ionization Mass Spectrometry*; Cole, R. B., Ed.; Wiley: New York, 1997, pp 114-115, the disclosures of which are incorporated herein by reference.) Van Berkel also noted a current surge measured when operating at high potential energies under ES conditions. (Van Berkel, G. J., The Electrolytic Nature of Electrospray, Chap. II. In *Electrospray Ionization Mass Spectrometry*; Cole, R. B., Ed.; Wiley: New York, 1997, p 14, the disclosure of which is incorporated herein by reference.) The observed current surge was attributed to corona discharge. Van Berkel noted that the corona discharge conditions were characterized by currents in excess of $10^{-6}$ amps and the presence of protonated cluster ions. Under these discharge conditions a degradation of the ES spectrum was observed; however, an increase in electrochemically generated ions from neutral analyte molecules was not reported. Corona discharge was also considered unfavorable to good ES conditions by Hail and Mylchreest. (See, Hail, M. & Mylchreest, I., U.S. Pat. No. 5,393,975, the disclosure of which is incorporated herein by reference.) To address this detrimental artifact the authors of that study designed a concentric gas desolvation tube surrounding the ES capillary to increase gas desolvation capabilities and to eliminate unwanted corona discharge.

The current invention uses corona discharge in combination with ES to provide an unexpectedly effective mechanism for ionization of the tip or outlet of the ES capillary by the surrounding gas to provide a source for electrochemical reactions. As discussed above, although this phenomenon has previously been recognized, these earlier reports only consider the electrons, plasma and subsequent ion-molecule reactions produced by the discharge and do not consider the electrochemistry occurring at the discharge outlet itself. (See, e.g., Uhm, H. S. & Lee, W. M., Physics of Plasmas. 1997, 4, 3117-3128; Gao, L., et al., J. Mass Spectrom. 2007, 42, 675-680; and Higashi, T., et al., Anal. Bioanal. Chem. 2006, 386, 658-665, the disclosures of which are incorporated herein by reference.) Moreover, the current invention does not require an additional APCI needle as is typical in conventional systems.

In short, unlike gas-phase processes where the corona discharge creates an ionic plasma and these ionic species subsequently react with neutral analytes, the current invention focuses on the electrochemical processes occurring at the edge of a capillary tube operated at high voltage. As shown in FIG. 1B, the corona discharge is created in the tip of the capillary itself and the plasma from this discharge is diverted away from the flow of liquid exiting the capillary. The analyte of interest passes through the tube and as it exits the tube outlet comes in contact with the ionized species created by the corona discharge. If the thermodynamic properties of the ionized capillary species and the analyte of interest are suitable, i.e., favor the ionization of the analyte over the capillary then the analyte will be itself ionized by the ionized capillary species. This system can be operated in two different modes.

In a positive ion mode electrons are being removed from the species in question (oxidized) so the relevant thermodynamic property of the materials is the ionization potential. If the ionization potential of the analyte is less than the oxidized species of the capillary an oxidation of the analyte occurs and an ionic species is sprayed into the ion source chamber of the mass spectrometer. Ionization potentials for some typical substances and molecules are provided in Table 1, below.

TABLE 1

Ionization Potentials

| Substance | Ionization Potential |
|---|---|
| $Ar \rightarrow -e^- + Ar^+$ | 18 V |
| $Fc^* \rightarrow -e^- + Fc^+$ | 6.7 V |
| Pt | 9 V |
| Fe | 8 V |

*Fc = Ferrocene

In a negative ion mode the relevant thermodynamic property is the analyte's ability to accept an electron, which is determined by the electronegativity of the analyte. Accordingly, in this case if the electronegativity of the analyte is greater than the reduced species of the capillary a reduction of the analyte occurs and an ionic species is sprayed into the ion source chamber of the mass spectrometer.

It has been discovered that maximizing the amount of corona discharge at the tip of the ES capillary significantly enhances the amount of electrochemically generated ions observed in the ES spectrum by providing a pathway for effective ionization of the tip of the ES capillary, thus creating EC conditions directly in the ES ion source. In summary, the current invention provides a highly sensitive and selective electrochemically based ionization method utilizing the standard features of ES design and hardware, by optimizing rather than suppressing the observable corona discharge in a process that will be referred to hereinafter as Corona Discharge Single Electrode Electrochemical Electrospray Ionization (CDSECSI).

Figure 2:
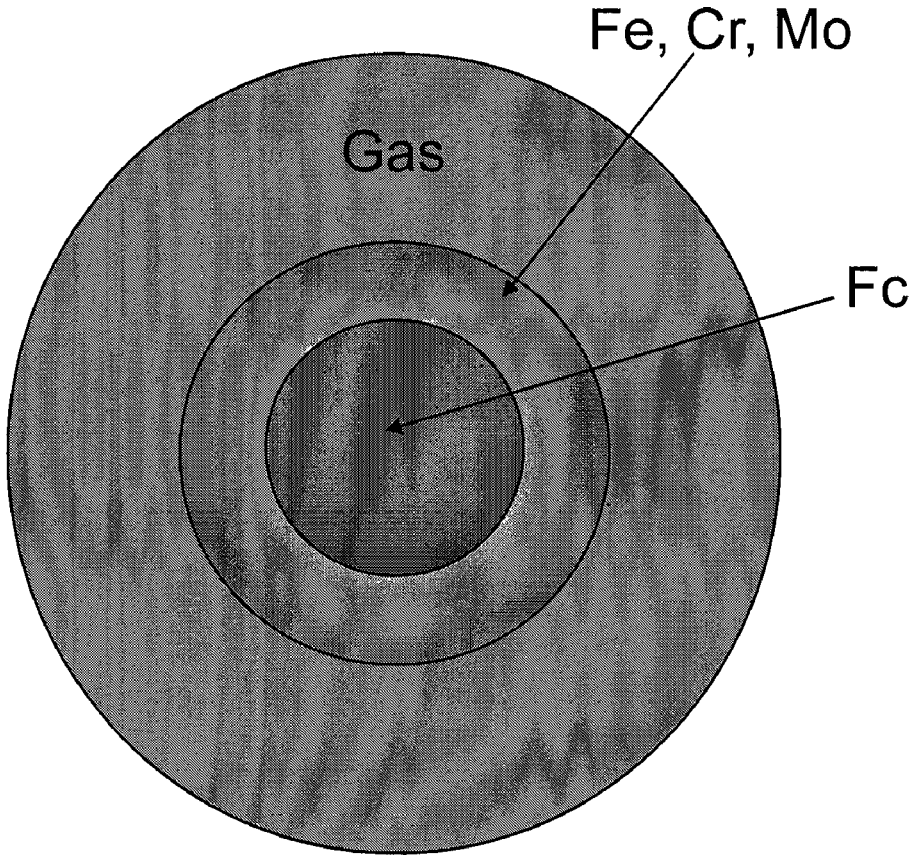
FIG. 2 provides a schematic of an electrochemical/electrospray ionization reaction in accordance with the current invention.

To provide a better understanding of the difference between conventional ES and the CDSECSI technique of the current invention, schematics of both techniques are provided in FIG. 1. As shown in FIG. 1A, in a conventional ES source electrons flow from the tip of the metal ES capillary to the HV power supply. Positively charged $[M+H]^+$ ions are then formed after solvent evaporation from highly charged droplets and subsequent droplet fission. In contrast, as shown in FIG. 1B, the approach of the current invention is fundamentally different in the following aspects: in positive ion mode a corona discharge, or more correctly a non-thermal corona discharge mechanism, removes electrons from the tip of the metal capillary. With a stainless steel capillary, the electrons with high positive potential energy are removed from an iron (Fe) atom located at the capillary's tip edge by a neutral gas molecule ($N_2$ in FIG. 1B) thus oxidizing Fe to $Fe^+$. The neutral analyte molecule (m) present in the HPLC eluting solution then comes in contact with the $Fe^+$ ion on the surface of the capillary and if the analyte has an ionization potential lower than Fe, a one-electron-oxidation of the analyte occurs generating a positively charged odd electron species $[M]^{+\bullet}$. The oxidized analyte molecule ion $[M]^{+\bullet}$ in solution is then sprayed and desolvated by the normal ES process. To complete the electrical circuit, the corona discharge generated $N_2^+$ eventually travels to a surface at ground potential and releases its electron. This process is shown diagrammatically in FIG. 2, which shows an orthogonal cross section of a metal ESI capillary. The inner circle is the eluent containing the sample of analyte, the middle section is the stainless steel metal ESI capillary, and the outer section is the surrounding gases present in the ESI ion source. The molecular reaction depicts the transfer of the electron from the metal to the gas followed by the transfer of an electron from the analyte molecule (in this case ferrocene) to the metal cation.

As will be described in greater detail in the examples below, in the CDSECSI ion source of the current invention the sensitivity of many redox labeled compounds exceed the observed sensitivity of ESI generated ions. As a demonstration studies of the intensity of the $M^+$ ion of the ferrocenyl boronate ester of glucose generated first by the native ECI process inherent in ESI, and then by the ECI process resulting from corona discharge were examined. These results are summarized in Table 2, below. As shown, in these studies the intensity of the $^{54}Fe$ isotope ion of the $M^+$ isotopic cluster was used for comparing the relative intensities so as to enhance the dynamic range of the comparison experiment. The $M^+$ ion is observed at m/z 374 under both conditions, but as shown its intensity is off-scale under CD ECI conditions.

TABLE 2

Comparison of Ion Intensity

| Ionization Mode | Capillary Voltage | Gas Temperature | M/z | Intensity (CTS) |
|---|---|---|---|---|
| ESI | 1250 | 325 | 372 | 5 |
| CDECI | 5000 | 500 | 372 | 10000 |
| Relative Intensity Increase | | | | 2000 |

In short, the current invention dramatically increases the sensitivity and robustness of electrochemical ionization using the CDSECSI ion source. The modified ion source optimizes the CD effect at the terminus of the ESI capillary, which in direct consequence optimizes the observed electrochemical ionization. Under corona discharge conditions the metal ESI capillary becomes a cold cathode where the gases in the source ionize the metal ESI capillary, subsequently initiating a concomitant ionization of the sample compound of interest to the metal capillary. More importantly, the electrochemical ionization produced by the corona discharge method remains effective over a wide range of solvent compositions and as a result is perfectly suited for LC/ECI/MS applications.

Although the physical structure of the CDSECSI device and a conventional ES device are facially similar, as shown in FIG. 1 and described above, it should be understood that a number of modifications are made to allow for the most effective practice of the CDSECSI technique of the current invention. A discussion of each of these parameters and their affect on the operation of the CDSECSI system of the current invention is summarized below:

- The tip of the metal capillary should have a sharp outer edge to encourage the production of a corona discharge, although any sharp outer edge capable of forming such a discharge may be used, one exemplary edge would be formed of a right-angle;
- The ground connection should also have a sharp edge and be positioned to attract the corona discharge gas plasma, this plasma removal from the electrochemically generated ions is mandatory to eliminate gas-phase ion molecule reactions as such gas-phase reactions only neutralize (reduce sensitivity) and complicate (make resulting spectrum incomprehensible) the desired electrochemically generated ions;

Increasing (more positive or more negative) the voltage on the metal capillary results in increased corona discharge, and subsequently the number of electrochemically generated positive ions;

Heating the gas will also increase the amount of corona discharge and thus the number of electrochemically generated ions;

Gases with increased electron transporting properties such as $CO_2$ and $SF_6$ can increase the number of electrochemically generated ions relative to gases such as $N_2$;

Whether an electrochemical reaction occurs is a function of the relative thermodynamic properties of the metal(s)/material(s) composing the capillary and the compounds present in the LC effluent, for example in a positive ion mode the relevant thermodynamic properties are the ionization potentials of the capillary and effluent, as such in this case a platinum capillary will ionize most other metals and organometallic compounds while a germanium capillary ionizes very few other metals (e.g., a Pt capillary will ionize ferrocene while germanium capillary will not); and The metal of the capillary can also be chosen to selectively fragment specific organic compounds. For example, an iron-containing (stainless steel) capillary will fragment phosphopeptides, which can in turn yield important structural information about particular analytes, such fragmentation of (phospho)peptides will not be observed with conventional time-of-flight measurements.

Some of these modifications, and specific parameters found to be effective to carry of CDSECSI in accordance with the current invention are summarized in Table 3, below:

TABLE 3

Parameters used for ESI and CDSECSI conditions

| Parameter | ESI | CDSECSI |
|---|---|---|
| Distance of Capillary to Desolvation Tube | max 0.5 mm | >2 mm |
| Capillary Voltage | 2 kV | ≧5 kV |
| Desolvation Temperature | 250° C. | >500° C. |
| Probe Entrance Cylinder of ESI | N/A* | grounded |
| Discharge | thermal | corona# |

*not applicable

#To achieve a stable corona discharge, the electrospray capillary is moved away from the ion entrance cone.

In summary, the distance of the capillary to the desolvation tube should preferably be increased to at least greater than 2 mm to prevent interaction between the ionized as and the analyte, the voltage applied to the nozzle should preferably be at least 5 kV, the desolvation temperature of the gas should preferably be at least 500° C., and the cylinder of the nozzle should preferably be grounded. Finally, the molecule to be investigated should preferably be redox active, and to prevent the neutralization of the ionized analyte the capillary should be arranged to prevent the creation of a non-thermal plasma from the interaction of the liquid jet of the electrosprayed solution with the outlet of the capillary. By using the parameters described herein it is possible to avoid unwanted ion-molecule reactions as they would be observed under conventional APCI conditions.

Figure 3:
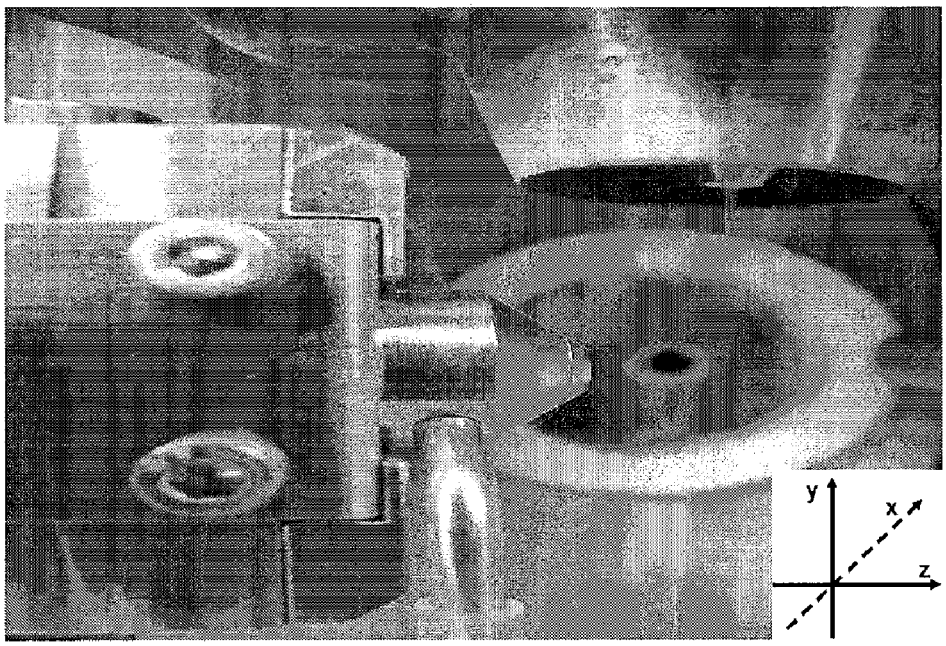
FIGS. 3*a* and 3*b* provides photographs of an exemplary electrochemical/electrospray ionization source in accordance with the current invention prior to activation (A); and under operating conditions (B)
Figure 3:
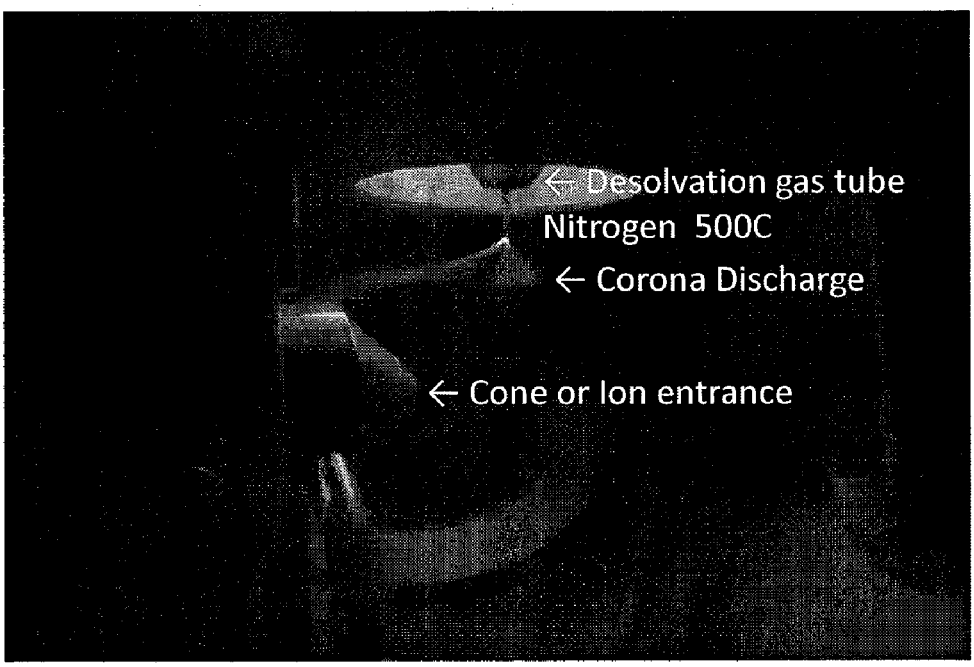

An exemplary device in accordance with the current invention is shown in the photographs provided in FIG. 3. As shown in those figures, only when the ESI capillary was moved away (in z-direction; see FIG. 3A) from the ion source entrance was a stable corona discharge to the ground plate observed as shown in FIG. 3B. In the embodiment shown and discussed in FIG. 3, the length of the stainless steel capillary was extended at least 3 mm beyond the desolvation tube to ensure greatest efficiency. In addition, the capillary voltage was set to 5 kV and the desolvation temperature was set to 500° C. Also, for electron flow to occur, the cylinder through which the ESI probe passes was grounded. By attending to these modifications, a thermal discharge (arching) between the ESI capillary and the ion entrance was observed, and stable ECI conditions were created.

Although one exemplary embodiment of the device is shown in FIGS. 1 and 3, and described herein, there are a number of optional parameters associated with the CDSECSI device of the current invention that can be further optimized. For example, beyond the specific parameters discussed above, any suitable combination of capillary construction, capillary geometry and application of potential energy can be utilized such that a stable electrochemical ionization reaction can be maintained.

For example, although any power supply capable of providing at least a 5 kV voltage can be used with the current invention, in a preferred embodiment the power supply is a frequency to voltage converter to prevent electron competition. In addition, although at least a 5 kV voltage may be applied to the capillary, in a preferred embodiment the voltage is increased to at least 8 kV. As another example, although only conventional stainless steel capillaries have been described thus far, a number of alternative capillary designs may be used. Possible capillary parameters that can be modified include: the dimensions of the capillary, the shape and surface area of the capillary, and the material of the capillary nozzle. For example, instead of using stainless steel a carbon or platinum nanotube capillary may be used that would allow for even greater electron densities and eliminate the need for a ferrocene label. Likewise, increasing the surface area or including a plurality of sharp edges on the capillary would serve to increase the electron density and the resultant ionization potential. Finally, the potential energy density applied to the gas may be optimized to increase the ionization of gases within the capillary nozzle, such as by utilizing a supplemental source of energy like ultraviolet, sound, or ICP or CCP electromagnetic impulses.

Turning now to the electrochemical reaction itself, although the above discussion focuses on the structure of the device, it should be understood that another critical aspect of the technique is the flexibility of the technique for investigation a wide range of species. Specifically, the current invention can be utilized to induce structurally diagnostic fragmentation of compounds of biological importance, such as, for example, peptide, peptide, lipid, carbohydrate and any mixture thereof (e.g. glycopeptides and lipopeptide, liposaccharides). Moreover, unlike many electrochemical techniques, the CDSECSI technique of the current invention can be utilized to fragment both redox labeled and unlabeled compounds of biological interest. Indeed, the only limitation is related to the relative ionization potential between the analyte in question and the oxidized species. Specifically, if the ionization potential of the analyte is less than the oxidized species of the capillary an oxidation of the analyte will occur to produce an ionic species, which can then be detected by a suitable method, such as, for example, a mass spectrometer.

The first type of corona discharge ECI induced ionization involves derivatizing the compound of interest with a redox active compound. In such a methodology an appropriate redox active labeling compound can be chosen and designed to effect basically the same process as described above but in a direct manner. The redox label is synthetically attached to a molecule and then is ionized under CDSECSI MS conditions. When corona discharge ECI ionization removes an electron from the redox active label, the process generates an odd electron positively charged ion. This odd electron cation then can be analyzed by a mass spectrometer. An example of such a labeling compound is N-(Ferrocenyl)iodoacetamide (Fc-IAA). Using standard peptide linking techniques, (Fc-IAA) can be linked to the SH group of cysteine containing peptides. Under corona discharge ECI conditions the generated odd electron ion easily dissociates and this results in many diagnostically useful fragment ions being observed. Similarly, other redox active labels can be designed to be reacted to the N- or C-terminus of peptides, lipids, carbohydrates and any mixture thereof (e.g. glycopeptides and lipopeptide, liposaccharides).

For example, in unlabeled compounds, such as peptides, a process referred to herein as electrochemically initiated metal catalyzed dissociation can be used. This is a specific example of a broader application of a second type of CDSECSI. In this process the peptide of interest first binds to one of the metals present in the ESI capillary and then under CDSECSI conditions the metal is ionized and the metal-peptide complex becomes an odd electron cation. The complex then dissociates into fragment ions yielding valuable structural information about the peptide such as amino acid sequencing information. For example, the phosphorylation site of a phosphopeptide can be determined by a mechanism in which the phosphopeptide first binds to one of the metals in the ESI capillary, then an electron is removed from the metal by the corona discharge electrochemical ionization process. The resulting odd-electron metal-peptide complex then fragments to yield diagnostic fragment ions observed in the mass spectrometer. This type of fragmentation is also observed in negative ion mode where the metal complexation-ECI process catalyzes a displacement reaction. For example, a disulfide bond is not reduced at the S—S bond but is displaced to yield an R—S—S-fragment ion.

Studies were conducted on these analytic techniques using devices designed in accordance with the descriptions provided above, and exemplary results are discussed in the examples below.

EXAMPLES

Reagents and Materials

In the data collected in the following examples, the following reagents and materials were used. HPLC grade water and acetonitrile, ferrocene boronic acid, reduced glutathione 99.9%, D-(+)-glucose ACS reagent grade, anhydrous DMSO 99.9%, formic acid 96%, dibasic potassium phosphate 99.9% and iodoacetic anhydride 99%, all of which were purchased from Sigma Aldrich (St. Louis, Mo.). Aminoferrocene was purchased from TCI America (Portland, Oreg.). Disulfide bonded somatostatin-14 was purchased from Bachem (King of Prussia, Pa.). Tris(2-Carboxyethyl)phosphine Hydrochloride (TCEP HCl) was from Pierce Chemical (Rockford, Ill.). 50 mM potassium phosphate buffer pH 7.5 in water was prepared as a stock solution.

Synthesis and Labeling

The synthesis of the ferrocenyl boronate ester of glucose was achieved following the procedure given by Brooks and Cole. (Brooks, C. J. W. & Cole, W. J., U.S. Pat. No. 6,734,024, the disclosure of which is incorporated herein by reference.) The synthesis of N-(Ferrocenyl)iodoacetamide (Fc-IAA) and its coupling to reduced glutathione was done as described by Lo et. al. (See, Lo, K. K.-W., et al., *J. Chem. Soc., Dalton Trans.,* 2002, 1753-1756, the disclosure of which is incorporated herein by reference.) The synthesis of the di-ferrocenyl acetamide derivative of somatostatin-14 was achieved using the following reaction steps. Somatostatin-14 (oxidized) (1.64 mg, 1 μmol) was reduced in 200 μL of 50 mM potassium phosphate buffer solution pH 7.5 containing TCEP (859.95 μg, 3 μmol). After 10 minutes of reaction time, 1 μL of the reducing reaction mixture was added to Fc-IAA (9.2 μg, 25 nmol) dissolved in 100 μL of acetonitrile. After 10 minutes 1 μL of the reaction solution was diluted with 1 mL of water. The final concentration of the di-ferrocenyl acetamide somatostatin derivative was 50 fmol/μL.

High Performance Liquid Chromatography (HPLC)

A Waters 1525u Binary HPLC was operated at a flow rate of 0.200 mL/min and 2 μL of the derivatized somatostatin were injected using the Waters 2777 Sample Manager. The HPLC column was an Agilent (Santa Clara, Calif.) Zorbax-SB C3 2.1×150 mm, 5 μm particle size. The HPLC solvents were 0.2% formic acid in water (mobile phase A) and acetonitrile containing 0.2% formic acid (mobile phase B). A gradient was run starting from 0% mobile phase B to 99% mobile phase B within 18 min. The eluent was directed to the MS.

Mass Spectrometry

Mass spectrometry experiments were conducted using a Waters (Milford, Mass.) LCT Premier Time-of-Flight mass spectrometer. With the exception of derivatized somatostatin-14, samples were generally injected via the injection loop of the LCT and pumped with a 1:1 mixture of mobile phase A and B. All corona discharge experiments were conducted using the standard Z-Spray™ orthogonal atmospheric pressure/electrospray ion source with the exception that we removed the integrated LockSpray™ device. The following features of the Z-Spray source were modified to achieving a stable, intense corona discharge capable of inducing electrochemical oxidations at the tip of the standard stainless steel electrospray capillary: (a) the knurled nut at the top of the Z-Spray source allows for adjustment of the stainless steel capillary and needed to extend 3 mm beyond the desolvation tube; (b) the capillary voltage was maximized; (c) the desolvation temperature was maximized; (d) the Z-spray source mounts to an adjustable base where the angle and distance of the electrospray capillary relative to the ion entrance cone needed to be adjusted to maximize the observable corona discharge; and (e) the cylinder through which the ESI probe passes was grounded.

All changes to ion source parameters were achieved using the "MS Tune" page of the MassLynx 4.0 software. All parameters except capillary voltage and desolvation temperature were set to normal operating values. The desolvation and cone gases were nitrogen. The cone gas flow was 30 L/hr and the desolvation gas flow was 300 L/hr.

Example 1

Sensitivity of CDSECSI Technique

In this example a normal ES stainless steel capillary is converted into an efficient, robust electrochemical cell capable of high sensitivity reversed phase high liquid pressure chromatography-mass spectrometry (RP HPLC-MS) analyses. Then an investigation is carried out to determine the possibility of conducting electrochemistry as a result of a stable corona discharge process. In the final step, RP HPLC-MS EC experiments are carried out under normal gradient conditions.

Ferrocenyl Boronate Ester of Glucose

Figure 4:
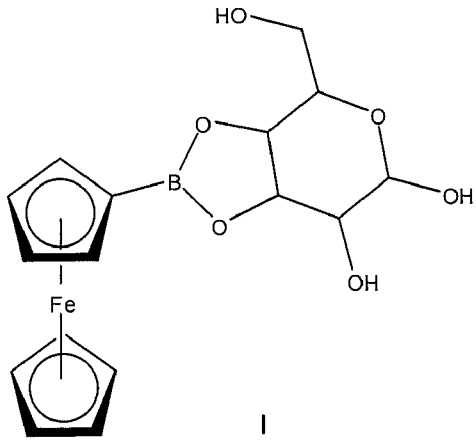
FIG. 4 provides a structural formula of exemplary ferrocene-labeled compounds in accordance with the current invention.
Figure 4:
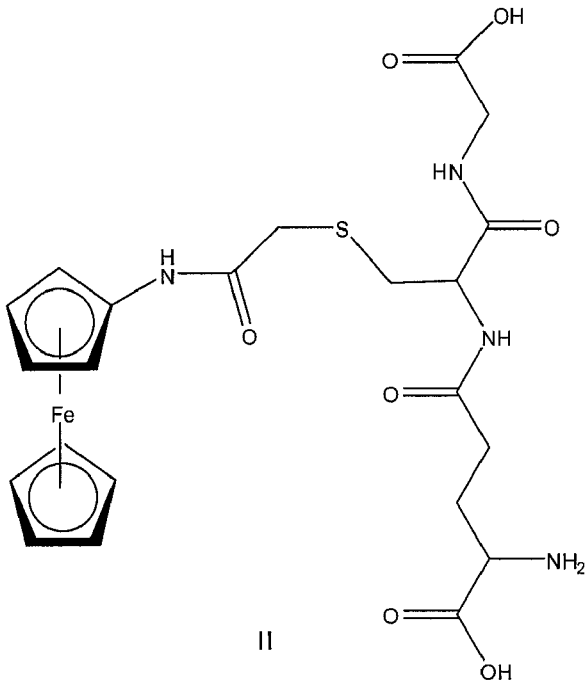
Figure 4:
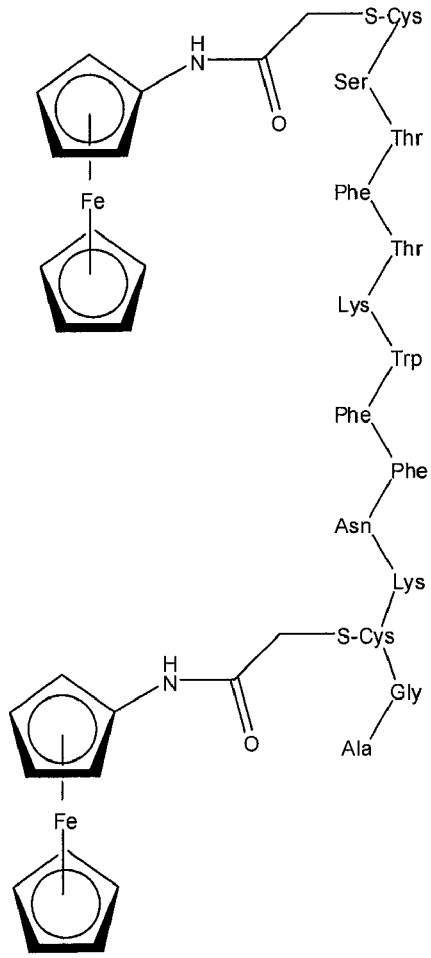
Figure 5:
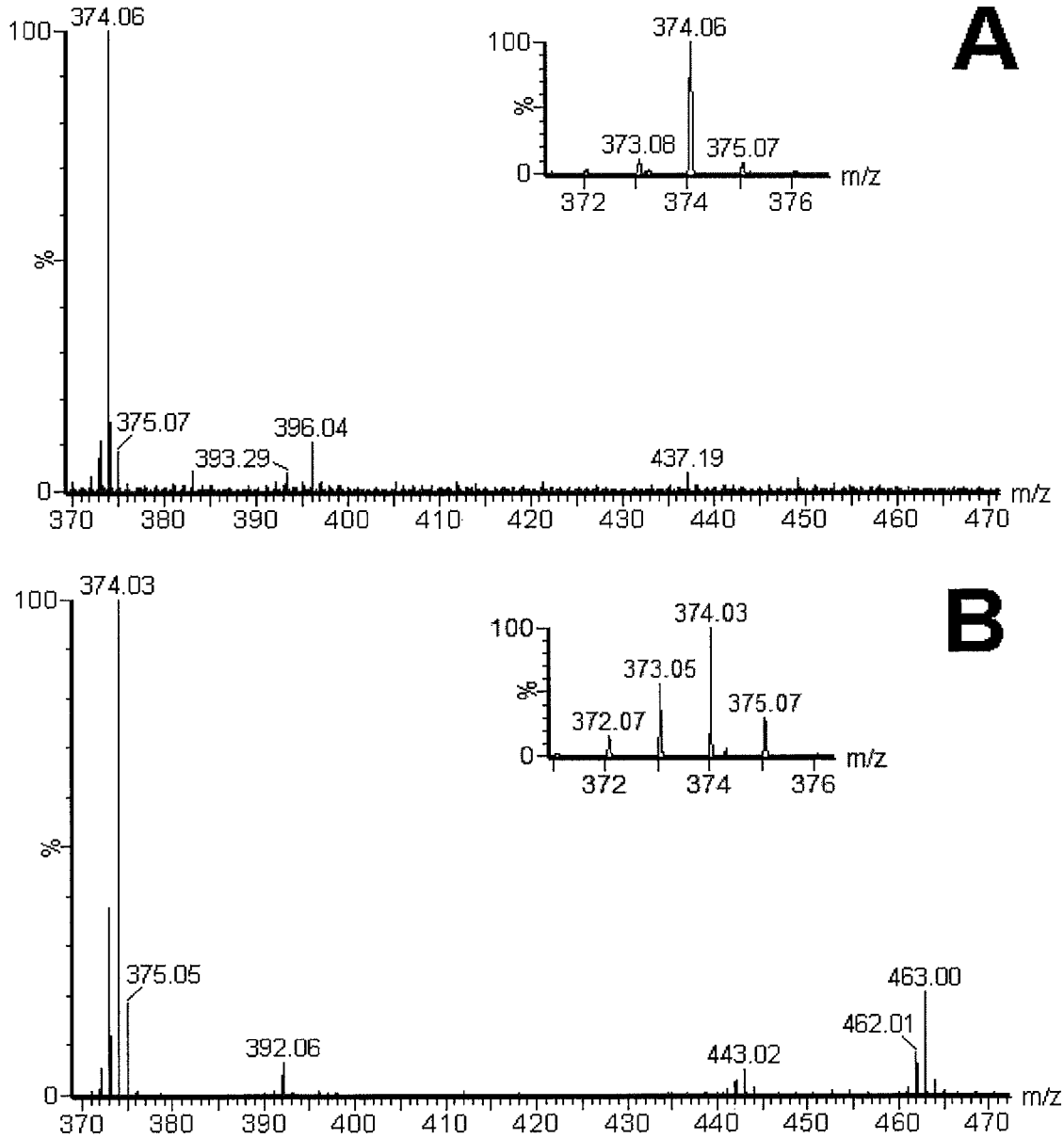
FIG. 5 provides a comparison of the spectra for ferrocenyl boronate ester of glucose (I) under electrospray ionization (A) and electrochemical/electrospray ionization (B) conditions.

To demonstrate the efficiency of the CDSECSI technique of the current invention versus a conventional ESI technique were studied. First, glucose was derivatized with ferrocene boronic acid to form the ferrocenyl boronate ester of glucose I ($C_{16}H_{19}O_6Fe_1B_1$; $M_R$=373.90 Da, FIG. 4). FIG. 5 shows the spectra using ESI (Panel A) and CDSECSI (Panel B) conditions. The signal for the $[M]^{+\bullet}$-ion at m/z=374 in ESI is very weak indicating only residual formation of electrochemical ionization under ESI conditions. In contrast, using CDSECSI conditions, the signal intensity was at least 2000 times stronger indicating the sensitivity of this technique. In addition, the CDSECSI spectrum showed peaks for the hydrolysed (or alternatively not fully reacted) product of (I) at m/z=392, the mono and disodium-formate adducts of (I) at 443 Da and 463 Da that corroborated its identification. Due to the lack of amine groups, glucose and its ferrocene boronic ester are usually poorly ionizable under ESI condition. The ferrocene boronic ester of glucose (I), however, showed very strong signal intensities under CDSECSI conditions.

S-Ferrocenyl Labeled Peptide

Figure 6:
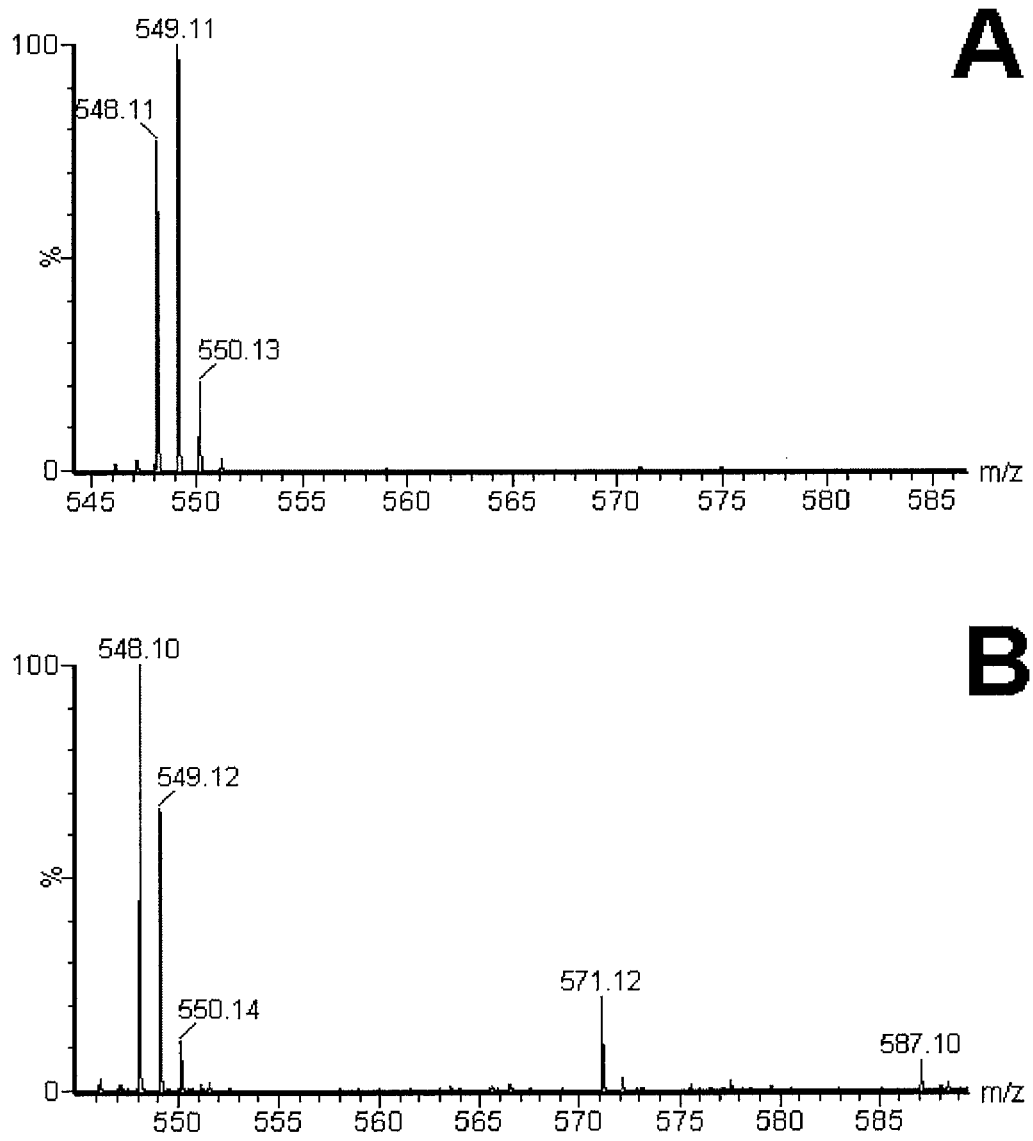
FIG. 6 provides a comparison of the spectra for S-ferrocene labeled glutathione (II) under electrospray ionization (A) and electrochemical/electrospray ionization (B) conditions.

To test whether this sensitivity gain is also observed with peptides, a sulfhydryl bearing tripeptide, glutathione, was reacted with ferrocene iodoacetamide. The resulting S-ferrocenyl labeled peptide (II), shown in FIG. 4, is ionizable by ESI and CDSECSI. Using standard ESI conditions, (II) (100 fmol; $C_{22}H_{29}N_4O_7S_1Fe_1$; $M_R$=548.39 Da) was analyzed by mass spectrometry and gave a $[M+H]^+$ ion at m/z=549. As shown in FIG. 6A, residual $[M]^{+\bullet}$ was also observed. Under CDSECSI conditions, the signal intensity of the $[M]^{+\bullet}$ ion at m/z=548 increased at least six-fold when compared to ESI conditions (FIG. 6B). In addition, the CDSECSI technique also allows simultaneous operation of the ESI ion source. The absolute intensity of the $[M^+H]^+$ ion remained unchanged. Both, $Na^+$ and $K^+$ adducts at m/z=571 and 587 were additionally observed under CDSECSI conditions. These results indicated that the CDSECSI conditions were more sensitive than ESI when electrochemically labeled peptides were investigated. The ferrocene-based iodoacetamide label was chosen since iodoacetamide treatment is most commonly used to protect free cysteine groups in proteomics experiments prior to tryptic digestion, indicating the potential of this technique for sensitive proteomics experiments.

RP-HPLC CDSECSI MS

Figure 7:
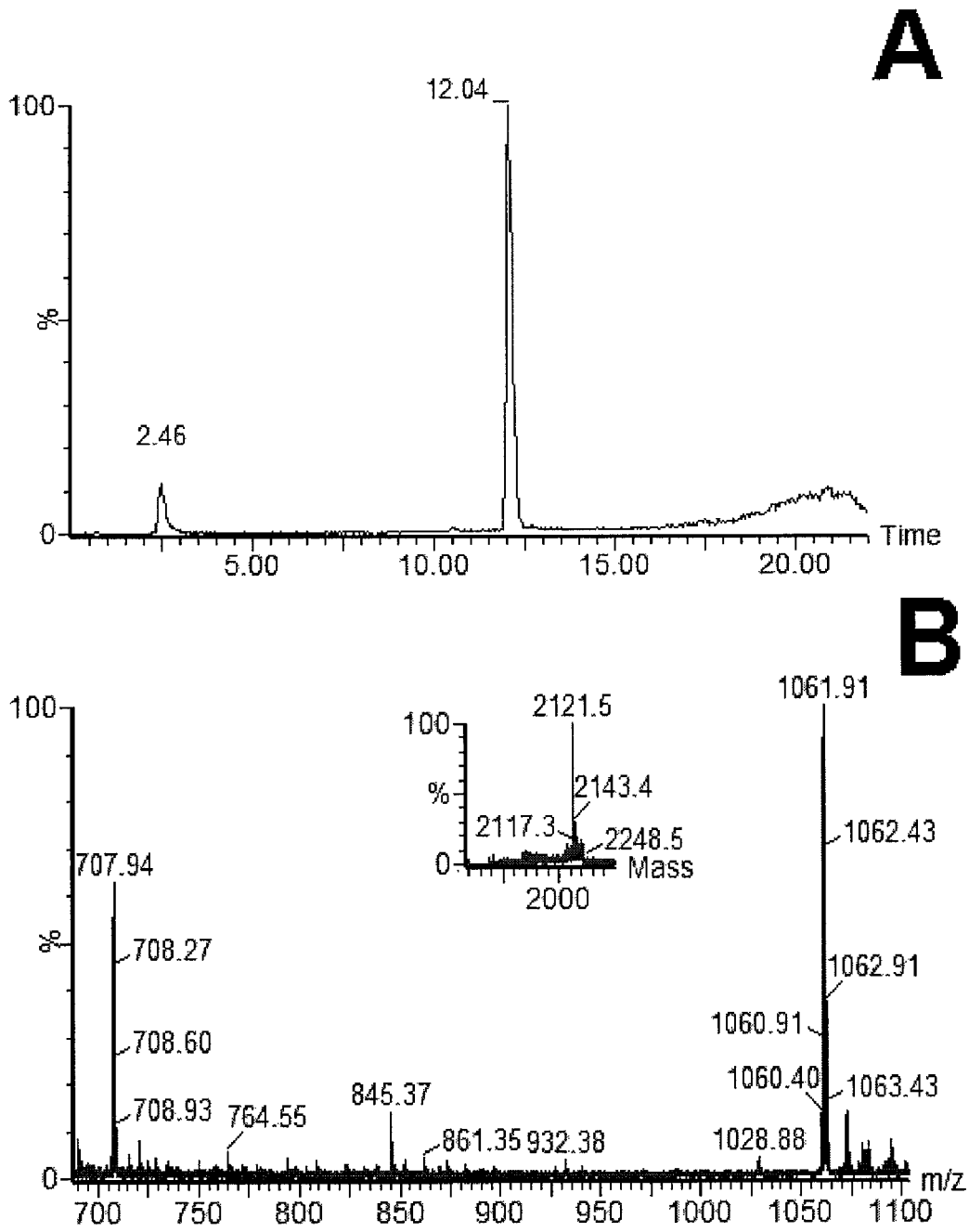
FIGS. 7A and 7B provide data from a somatostatin reaction using the electrochemical/electrospray ionization technique interfaced with LC-MS.

To further explore whether ferrocene-based labels would be stable under standard RP HPLC conditions, reduced somatostatin-14 was reacted with ferrocene iodoacetamide to form (III) (FIG. 4). In the CDSECSI spectrum, the peak eluting at 12.04 minutes shown in FIG. 7A showed intense doubly and triply charged ions at m/z=708 and m/z=1062, respectively (FIG. 7B). After deconvolution, the expected $M_R$=2121.5 Da was obtained, indicating two ferrocene iodoacetamides had reacted with the free cysteines of somatostatin-14. In addition, a sodium adduct was observed at $M_R$=2134.5 Da. This clearly indicated that the ferrocene-based labels were stable under standard RP HPLC conditions.

Ethynyl Ferrocene with Azide

Figure 8:
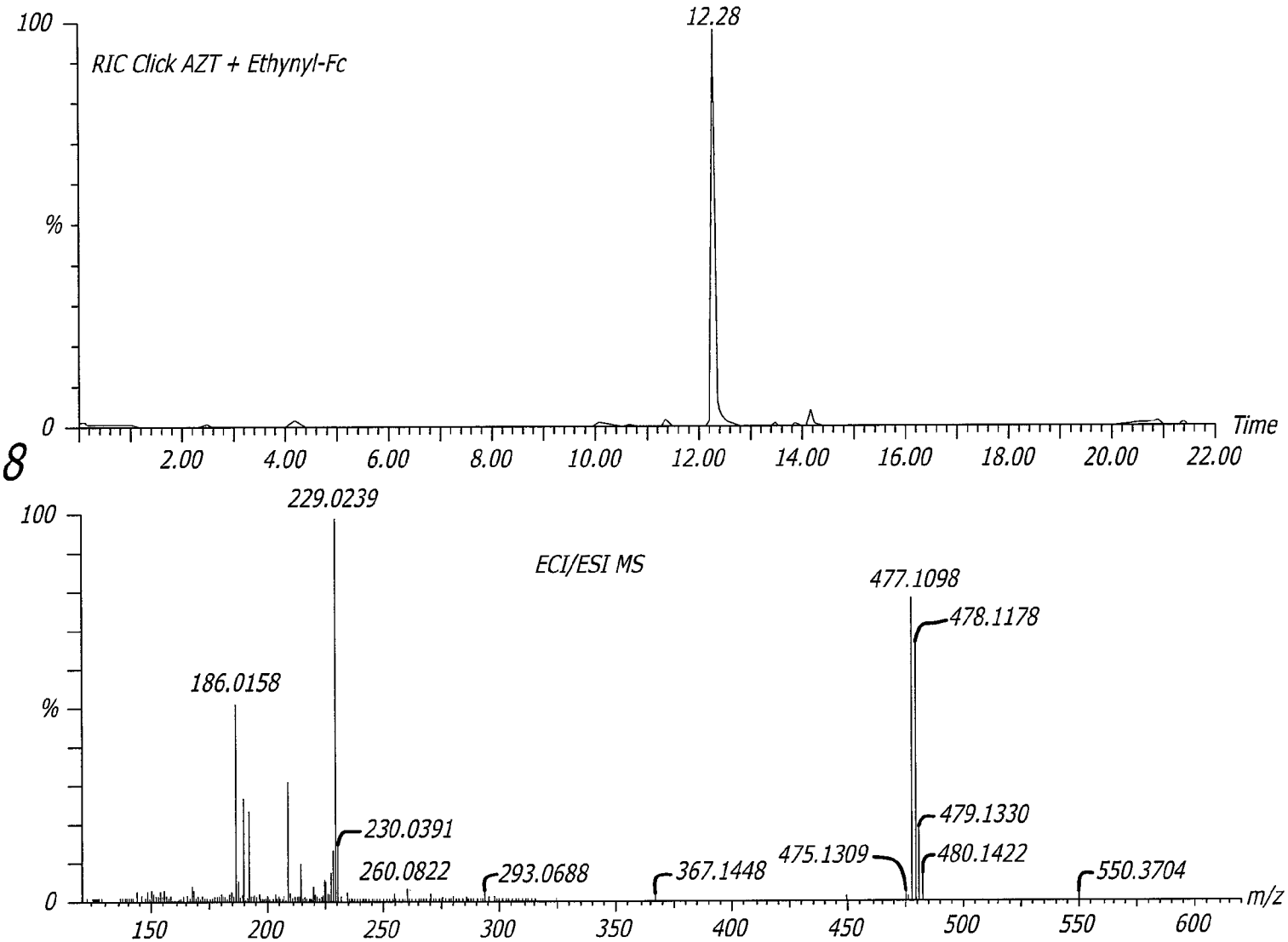
FIG. 8 provides data from an azide reaction using the electrochemical/electrospray ionization technique in accordance with the current invention.

An additional example of corona discharge CDSECSI ionization using a commercially available redox label, ethynyl ferrocene with an azide is shown in FIG. 8. As shown, the CDSECSI technique shows heightened sensitivity. Analogous schemes are widely used in glycopeptide research, indicating that CDSECSI would be a valuable addition to this type of research.

Example 2

CD SECSI MS Structural Studies

FIGS. 9 to 14 provide results of investigations of the possibility of using CDSECSI MS as a dissociation method to obtain structural information from biologically important compounds. Using the CDSECSI fragmentation mechanism of the current invention, a number of different systems were investigated.

Figure 9:
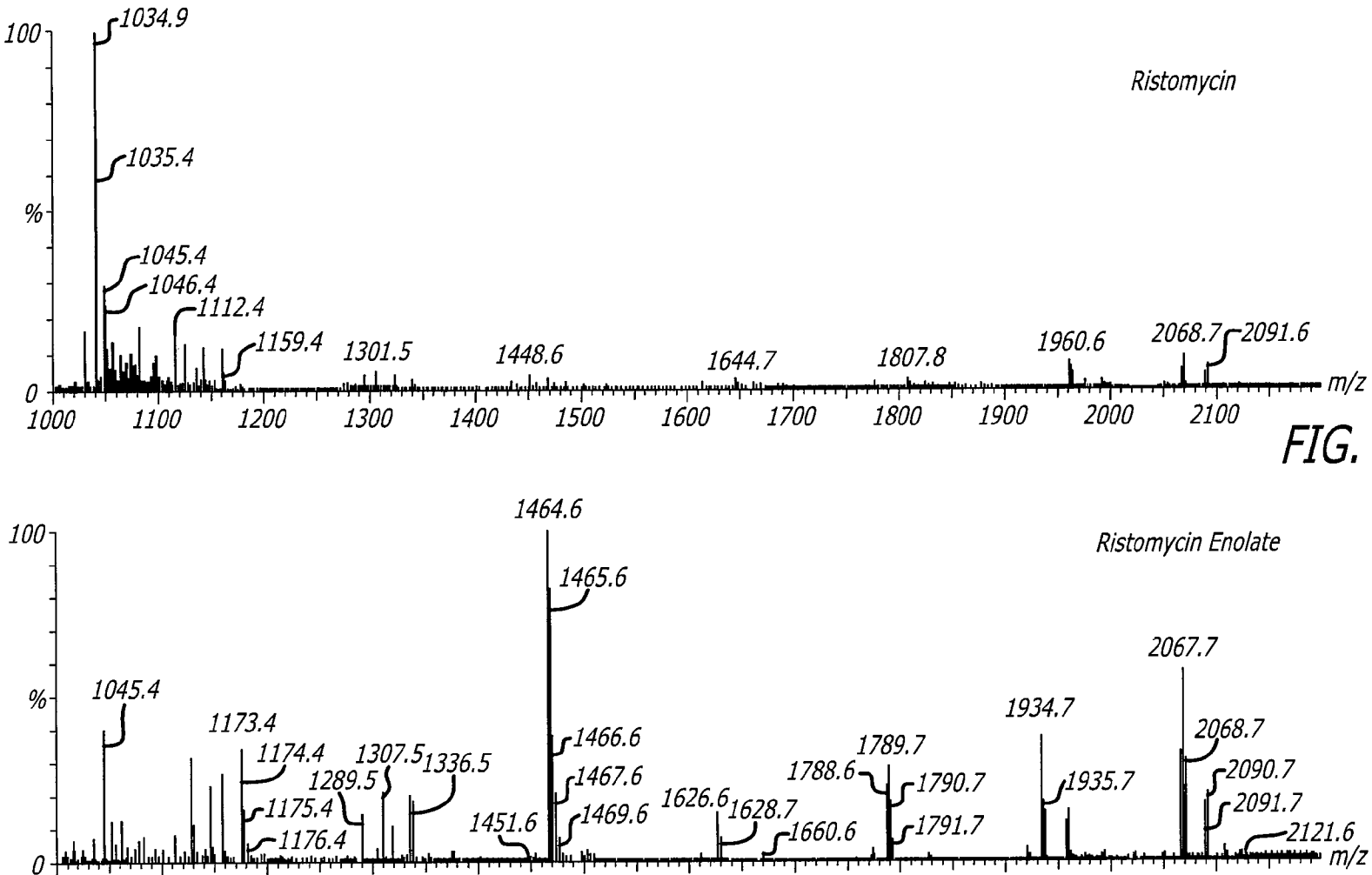
FIGS. 9 to 11 provide data on the fragmentation of enolated ristomycin using the electrochemical/electrospray ionization technique in accordance with the current invention.
Figure 10:
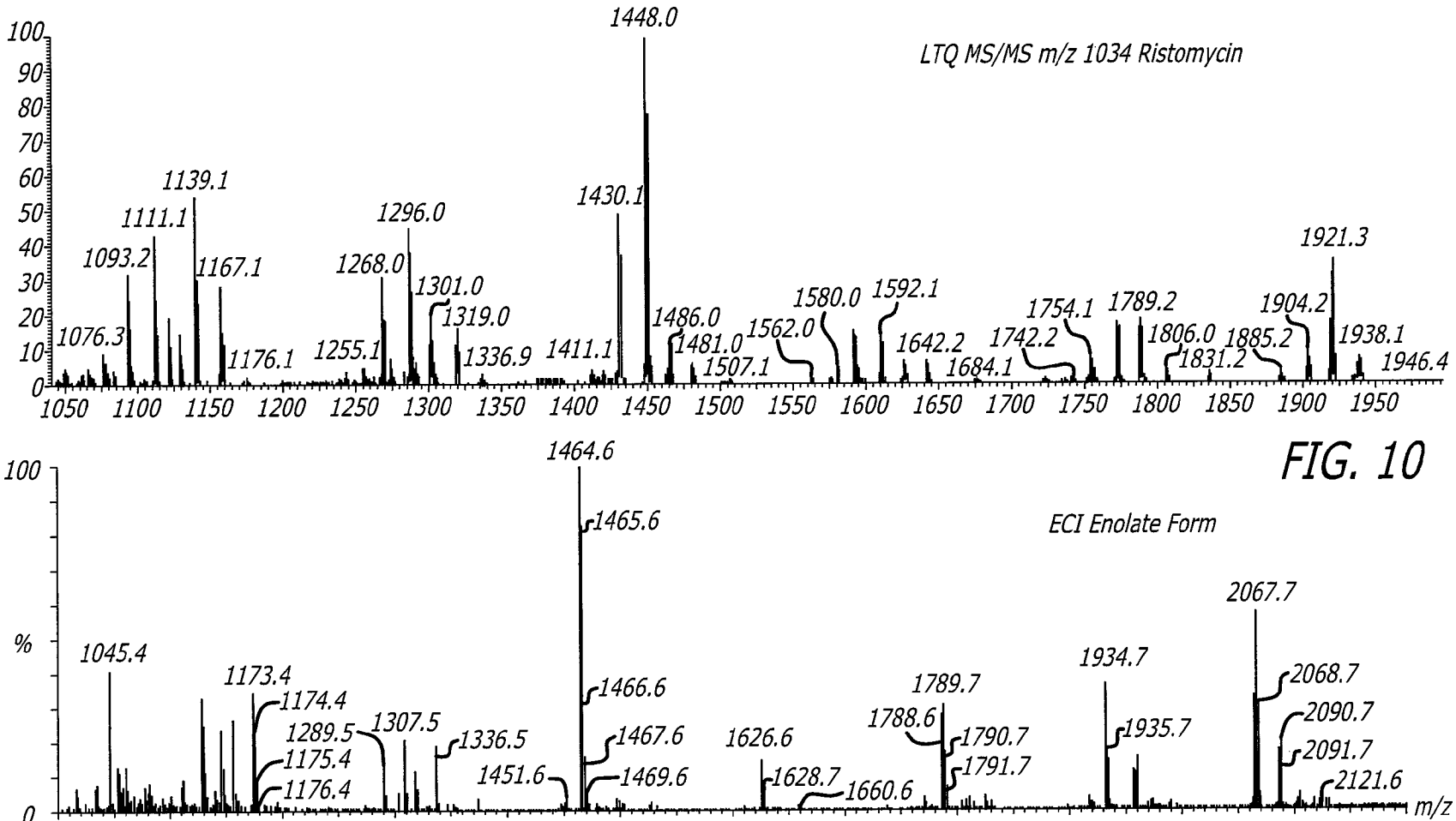

For example, in FIGS. 9 and 10 the fragmentation of ristomycin was observed. As shown in FIG. 9, it can be observed that ristomycin exists in two forms one being an enolate. The enolate form, as shown in FIG. 10 shows extensive fragmentation under CDSECSI-MS conditions due to an electrochemically initiated metal catalyzed (ECIMC) process where the compound (enolate form only) initially binds to the metal of the ESI capillary and this metal complex is subsequently ionized by the CD ECI process. The odd electron cation generated then facilely fragments to yield useful structural information.

Figure 11:
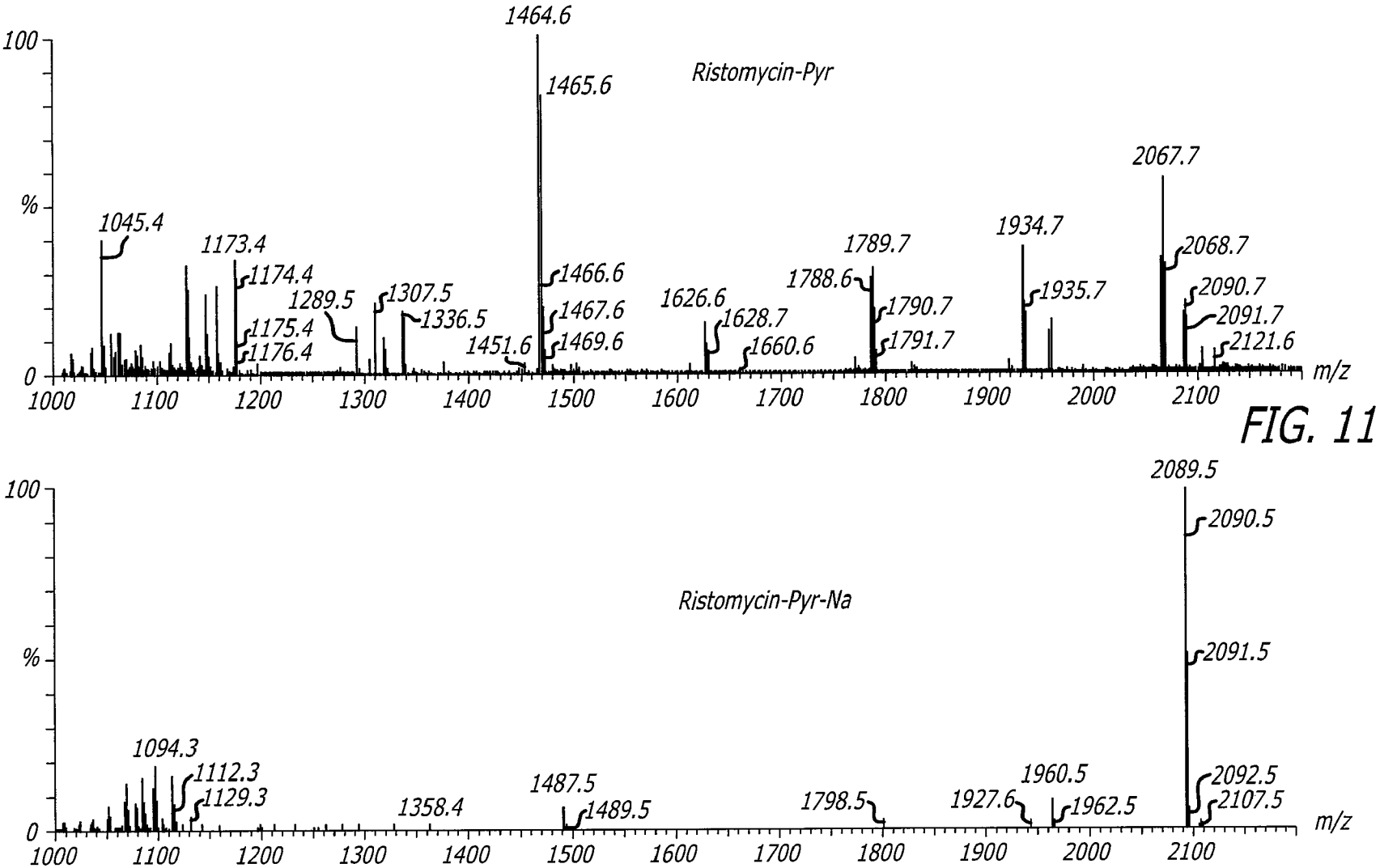

In combination with this study, FIG. 11 provides data on a study that detailed how the mechanism of ECIMC might be customized using the enolate form of ristomycin as a specific example. In this study sodium was added to the ristomycin thereby blocking the zwitterionic enolate. Specifically, the addition of sodium cation blocks the metal from attaching to the enolate, and, as shown in FIG. 11, in turn blocks the ECIMC fragmentation pathway. This study indicates that different metals or catalysts could be used to design labels and label catalysts to provide more specific cleavage of a protein.

Figure 12:
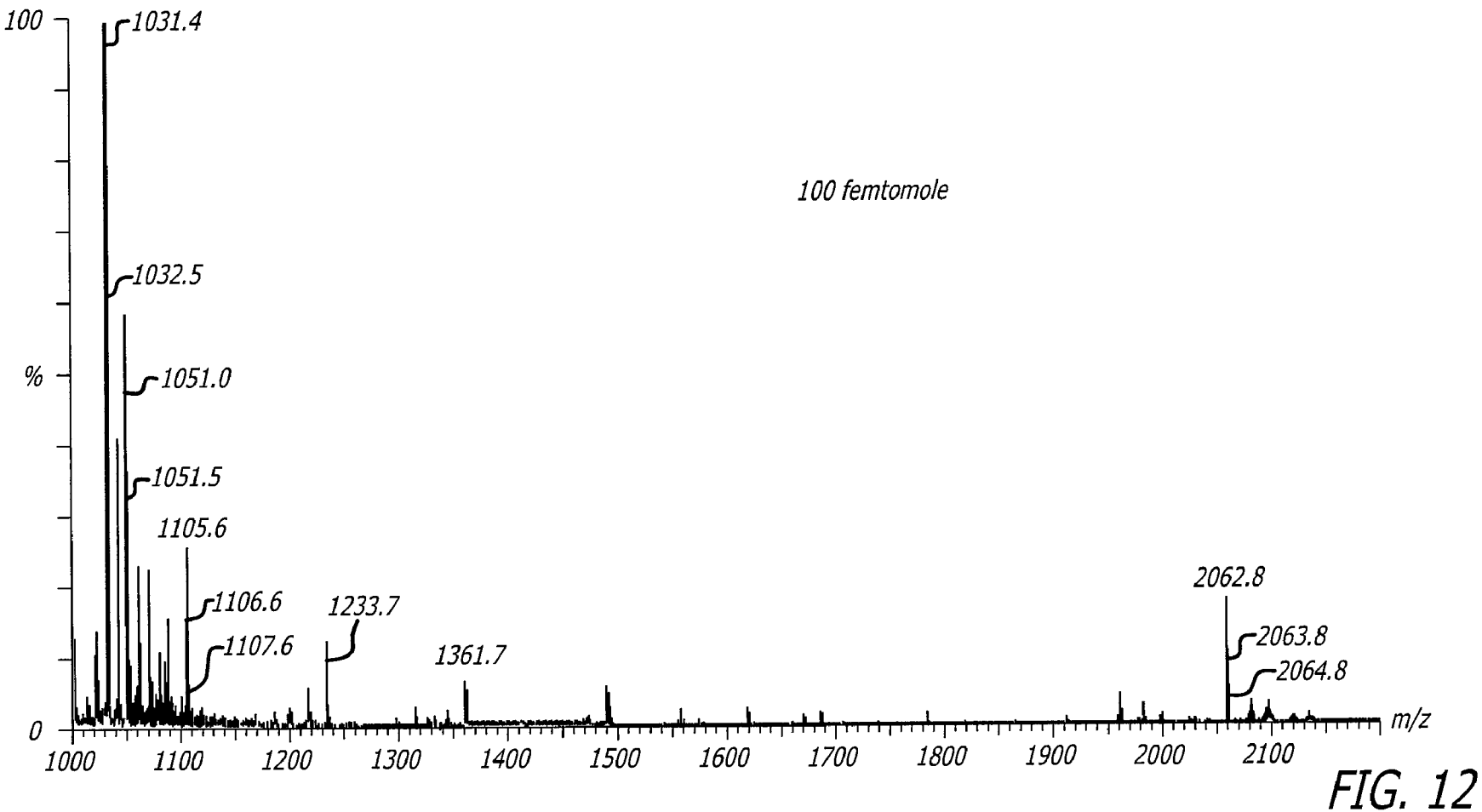
FIGS. 12 and 13 provide data on the location of the position of a phosphoserine in a peptide using electrochemical/electrospray ionization fragmentation.
Figure 13:
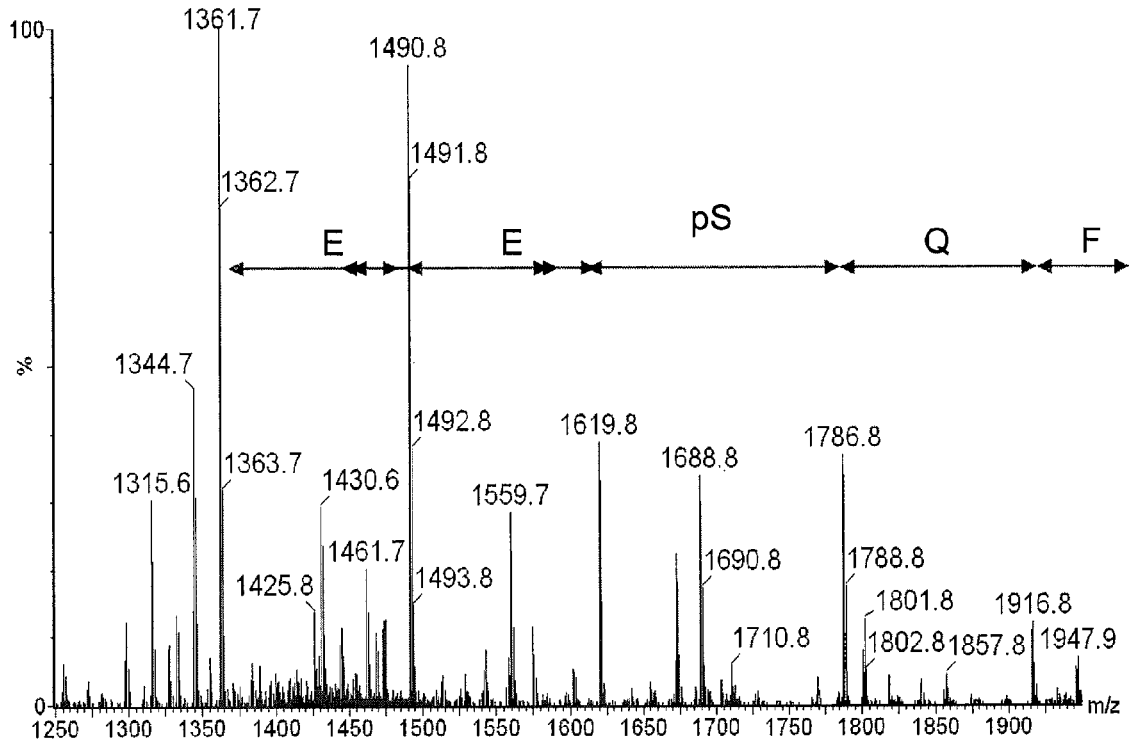

FIGS. 12 and 13 provide another example that shows that the ECIMC process of the current invention can be used to locate the position of the phosphoserine in a peptide. Specifically, in FIG. 12 an ECI LC-MS of a phosphopeptide of F-Q-pS-E-E-Q-Q-Q-T-E-D-E-L-Q-D-K is shown. In FIG. 13, a spectrum taken after fragmentation under CDSECSI conditions is provided which shows the technique's ability to provide information about the position of the phosphoserine in the peptide. Typically, this type of information is very difficult to obtain using anything other than very expensive FT MS instruments with ECD detection.

Figure 14:
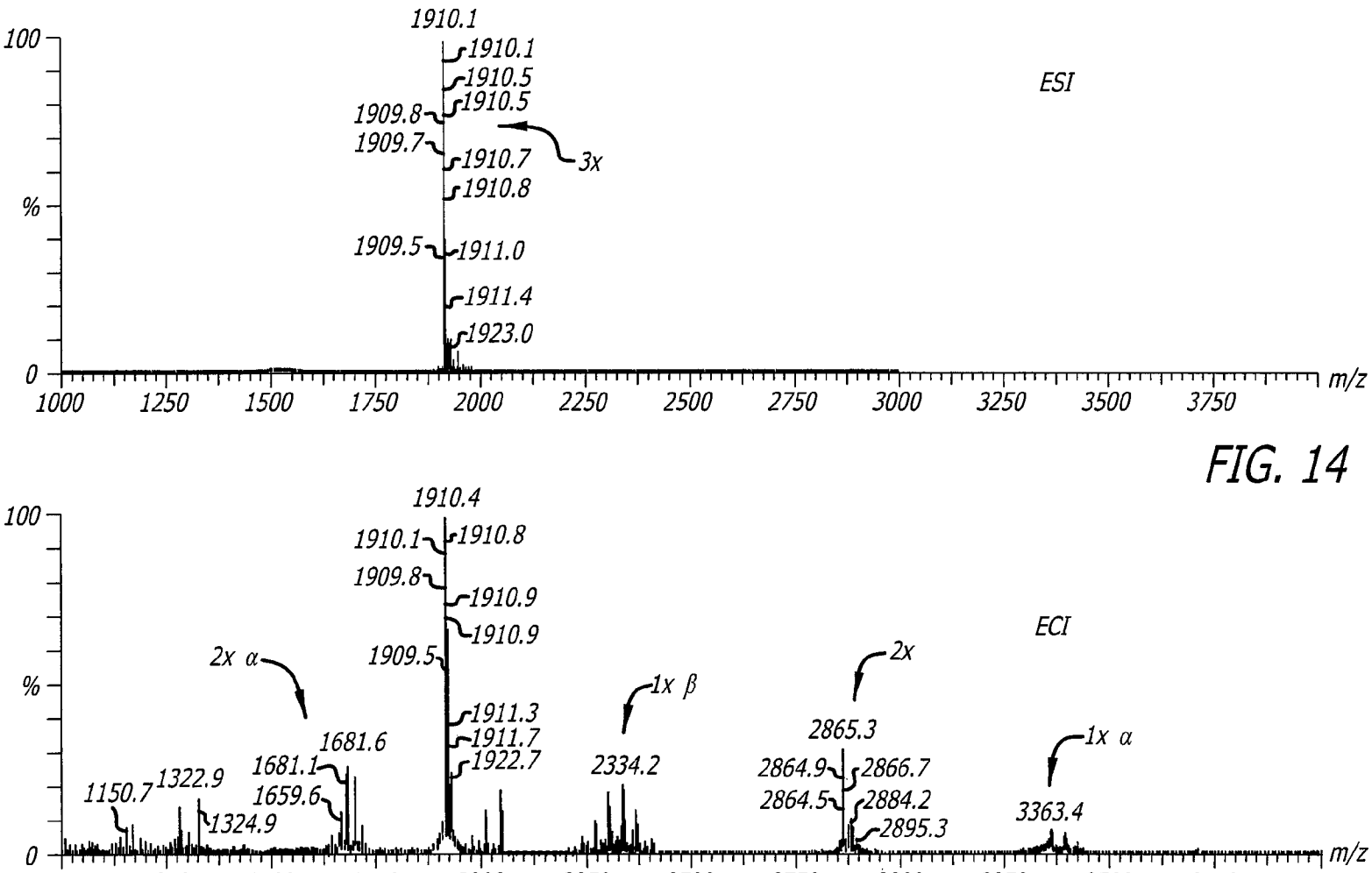
FIG. 14 provides data on the fragmentation of bovine insulin using electrochemical/electrospray ionization in a negative ion mode.

FIG. 14, meanwhile, provides an example of ECIMC in negative ion mode. Specifically in this embodiment the disulfide bonds of 3 pmol solution of bovine insulin are cleaved not by the usual reduction pathway but by a displacement mechanism. As illustrated, the ECIMC method fragments the insulin but it actually maintains the disulfide bonds, a phenomenon that can be diagnostically useful.

Example 3

Nanospray Device

Although only conventional ES-based CDSECSI sources have been shown and discussed thus far, it should be understood that the current invention can also be used with micro or nanospray sources. There are two major advantages of such devices:

Sensitivity. The corona/discharge mechanism is not an equilibrium process like electrospray. By maximizing the corona discharge it is possible to achieve significantly superior sensitivities. The micro/nanospray capability also allows for greater sensitivity.

Selectivity. By selecting different materials for the capillary it is possible to tune the ionization process to uniquely ionize specific compounds. For example a Nickel wire will not ionize iron compounds, but will ionize gadolinium containing compounds.

Figure 15:
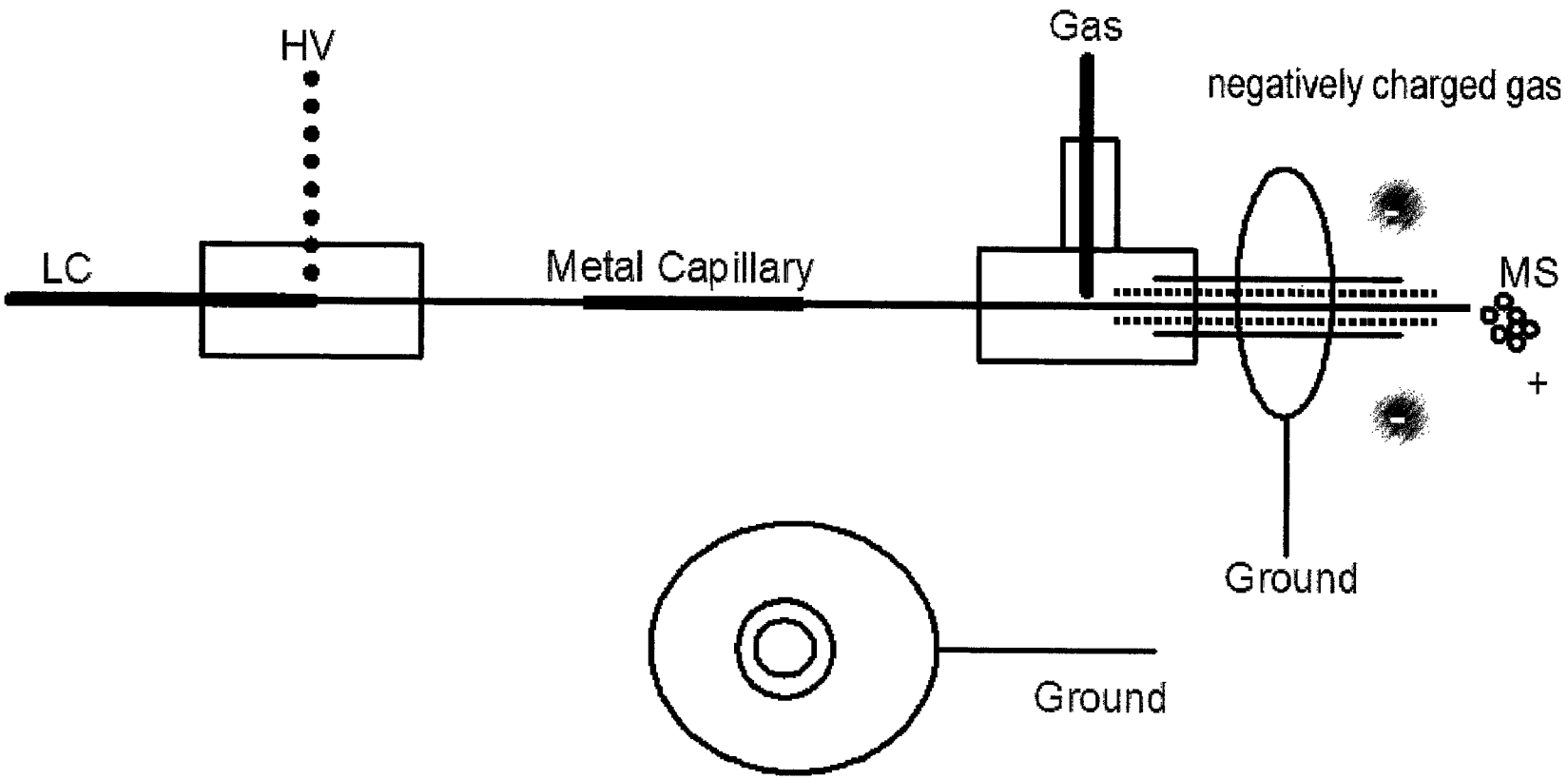
FIG. 15 provides a schematic diagram of an exemplary nanospray electrochemical/electrospray ionization device in accordance with the current invention.

The schematic shown in FIG. 15 shows an exemplary device capable of producing ions on the micro/nanospray scale for analysis by MS using the CDSECSI process of the current invention. The union on the left is a metal union (e.g. from Upchurch) transferring the liquid output of the HPLC to a conductive capillary. A high voltage connection is made to the exterior of the metal union resulting in high voltage passing to the liquid and the metal capillary. Voltages greater than 3 KV are typically required. The capillary has an ID of 20 um and an OD of 360 um. The capillary material can be anything that is conductive, but as discussed the type of material will influence whether the compound of interest will ionize or not.

The capillary simply passes through the gas tight tee on the right and then through the sheath gas tube. The capillary extends approx. 3 mm beyond the end of the sheath gas tube. The tee on the right allows a gas such as carbon dioxide to pass around the high voltage metal capillary where an electron is passed from the edge of the capillary to the gas via a corona discharge mechanism. Subsequently the capillary is positively charged and the gas is negatively charged. If the ionization potential of the compound of interest is lower than the metal/material, oxidation of the compound occurs. The resulting ion is desolvated and passed on to the MS for analysis. The negatively charged gas molecule is attracted to a grounding band where it transfers an electron completing the electrochemical circuit.

SUMMARY

The current invention provides an ECI/ESI source by creating a stable corona discharge. Spectra for ferrocene labeled glucose and peptides were obtained. Using the appropriate electrochemically active ferrocene-label, the ECI conditions proved to be highly sensitive. Depending on the investigated molecule species, the sensitivity of the technique of the current invention was 6 to 2000 times higher than conventional ESI techniques. Finally, it was determined that ferrocene-labeled peptides were stable under RP-HPLC conditions.

While the above description contains many specific embodiments of the invention, these should not be construed as limitations on the scope of the invention, but rather as an example of one embodiment thereof. For example, although the optimal performance can be achieved by adjusting the capillary voltage, desolvation temperature, the stainless steel capillary to create a stable corona discharge, as discussed throughout this disclosure other detection and optical schemes may be used. Moreover, the principle of this technique is not limited to the specific redox molecules described herein, but can be extended to use other molecules having appropriate ionization potentials providing even greater application flexibility. Accordingly, the scope of the invention should be determined not by the embodiments illustrated, but by the appended claims and their equivalents.

What is claimed is:

1. An electrochemical electrospray ionization source comprising:

a conductive capillary having a first end in fluid communication with a reservoir of an analyte and a second end having an outlet and defining an outer surface layer, said outlet being positioned within an atmosphere of an ionizable gas such that the outer surface layer is in contact with said ionizable gas;

a high voltage power supply in electrical communication between the capillary and a ground such that application of a high voltage to the capillary creates a stable corona discharge at the outlet of said capillary, said corona discharge activating a redox reaction between the outer surface layer of the capillary and the gas such that surface ions are formed on at least a portion of the outer surface layer of the capillary; and wherein the outer surface layer of the capillary is formed from a material that is selected such that the analyte flowing through the capillary is ionized by the surface ions of said capillary.

2. The electrochemical electrospray ionization detector system of claim 1, wherein the source can operate to form surface ions at the capillary outlet in one of either a positive ion mode or a negative ion mode;

wherein in the positive ion mode the corona discharge transfers electrons from the outer surface of the capillary outlet to the surrounding gas forming an electron deficient capillary surface and where the material of the capillary is selected such that the ionization potential of the analyte is less than the ionization potential of the material of the capillary; and wherein in the negative ion mode the corona discharge transfers electrons from the surrounding gas to the outer surface of the capillary outlet forming an electron rich capillary surface in a negative ion mode, and where the material of the capillary is selected such that the electronegativity of the analyte is greater than electronegativity of the material of the capillary.

3. The electrochemical electrospray ionization source of claim 1, further comprising a heater in contact with the gas such that the gas may be heated to a temperature of at least 500° C.

4. The electrochemical electrospray ionization source of claim 1, wherein the outlet comprises a plurality of sharp conducting tips.

5. The electrochemical electrospray ionization source of claim 1, wherein the capillary is comprised of a material selected from the group consisting of: stainless steel, platinum and carbon.

6. The electrochemical electrospray ionization source of claim 1, wherein the power supply provides a voltage of at least 5 kV.

7. The electrochemical electrospray ionization source of claim 2, wherein the gas is an electron accepting gas selected from the group consisting of $CO_2$, $NO_2$, $SF_6$ and $N_2$ in the positive ion mode, and wherein the gas is an electron donating noble gas in the negative ion mode.

8. The electrochemical electrospray ionization source of claim 1, wherein the analyte is labeled with a redoxactive molecule.

9. The electrochemical electrospray ionization source of claim 8, wherein the redoxactive label molecule is an organometallic.

10. The electrochemical electrospray ionization source of claim 1, wherein the analyte is a peptide, lipid, carbohydrate and a mixture thereof.

11. The electrochemical electrospray ionization source of claim 1, wherein the capillary is one of either a micro or nano scale capillary.

12. The electrochemical electrospray ionization source of claim 1, wherein the outlet of the capillary is arranged such that the ionized analyte does not interact with the ionized gas.

13. An electrochemical electrospray ionization detector system comprising:

a conductive capillary having a first end in fluid communication with a reservoir of an analyte and a second end having an outlet and defining an outer surface layer, said outlet being positioned within an atmosphere of an ionizable gas such that the outer surface layer is in contact with said ionizable gas;

a high voltage power supply in electrical communication between the capillary and a ground such that application of a high voltage to the capillary creates a stable corona discharge at the outlet of said capillary, said corona discharge activating a redox reaction between the outer surface layer of the capillary and the gas such that surface ions are formed on at least a portion of the outer surface layer of the capillary; and wherein the outer surface layer of the capillary is formed from a material that is selected such that the analyte flowing through the capillary is ionized by the surface ions of said capillary; and a detector in fluid communication with the outlet of the capillary for detecting the ionized analyte.

14. The electrochemical electrospray ionization detector system of claim 13, wherein the source can operate to form surface ions at the capillary outlet in one of either a positive ion mode or a negative ion mode;

wherein in the positive ion mode the corona discharge transfers electrons from the outer surface of the capillary outlet to the surrounding gas forming an electron deficient capillary surface and where the material of the capillary is selected such that the ionization potential of the analyte is less than the ionization potential of the material of the capillary; and wherein in the negative ion mode the corona discharge transfers electrons from the surrounding gas to the outer surface of the capillary outlet forming an electron rich capillary surface in a negative ion mode, and where the material of the capillary is selected such that the electronegativity of the analyte is greater than electronegativity of the material of the capillary.

15. The electrochemical electrospray ionization detector system of claim 13, further comprising a heater in contact with the gas such that the gas may be heated to a temperature of at least 500° C.

16. The electrochemical electrospray ionization detector system of claim 13, wherein the outlet comprises a plurality of sharp conducting tips.

17. The electrochemical electrospray ionization detector system of claim 13, wherein the capillary is comprised of a material selected from the group consisting of: stainless steel, platinum and carbon.

18. The electrochemical electrospray ionization detector system of claim 13, wherein the power supply provides a voltage of at least 5 kV.

19. The electrochemical electrospray ionization detector system of claim 13, wherein the detector is selected from the group consisting of: a mass spectrometer, a gas chromatograph, a high pressure liquid chromatograph, and an ultrahigh pressure liquid chromatograph.

20. The electrochemical electrospray ionization source of claim 13, wherein the gas is an electron accepting gas selected from the group consisting of $CO_2$, $NO_2$, $SF_6$ and $N_2$ in the positive ion mode, and wherein the gas is an electron donating noble gas in the negative ion mode.

21. The electrochemical electrospray ionization detector system of claim 13, wherein the analyte is labeled with a redoxactive molecule.

22. The electrochemical electrospray ionization detector system of claim 21, wherein the redoxactive label molecule is an organometallic.

23. The electrochemical electrospray ionization detector system of claim 13, wherein the analyte is a peptide, lipid, carbohydrate and any mixture thereof.

24. The electrochemical electrospray ionization detector system of claim 13, wherein the capillary is one of either a micro or nano scale capillary.

25. The electrochemical electrospray ionization detector system of claim 13, wherein the outlet of the capillary is arranged such that the ionized analyte does not interact with the ionized gas.

26. A method of forming an ionized species comprising:

providing a conductive capillary defining an outer surface layer and having an outlet;

providing an atmosphere of an ionizable gas species in proximity to said outlet of said capillary;

applying a high voltage to the conductive capillary such that a stable corona discharge is produced at the outlet to the capillary, wherein said corona discharge activates a redox reaction between said capillary and said gas such that surface ions are formed on at least a portion of the outer surface layer of the capillary;

introducing an analyte through said capillary, such that the analyte flowing through the capillary is ionized by said surface ions; and preventing the corona discharge generated plasma from interacting with the ionized analyte.

27. The method of claim 26, wherein the source can operate to form surface ions at the capillary outlet in one of either a positive ion mode or a negative ion mode;

wherein in the positive ion mode the corona discharge transfers electrons from the outer surface of the capillary outlet to the surrounding gas forming an electron deficient capillary surface and where the material of the capillary is selected such that the ionization potential of the analyte is less than the ionization potential of the material of the capillary; and wherein in the negative ion mode the corona discharge transfers electrons from the surrounding gas to the outer surface of the capillary outlet forming an electron rich capillary surface in a negative ion mode, and where the material of the capillary is selected such that the electronegativity of the analyte is greater than electronegativity of the material of the capillary.

28. The method of claim 26, further comprising heating the gas to a temperature of at least 500° C.

29. The method of claim 26, wherein the outlet comprises a plurality of sharp conducting tips.

30. The method of claim 26, wherein the capillary is comprised of a material selected from the group consisting of: stainless steel, platinum and carbon.

31. The method of claim 26, wherein a voltage of at least 5 kV is applied to the capillary.

32. The electrochemical method of claim 27, wherein the gas is an electron accepting gas selected from the group consisting of $CO_2$, $NO_2$, $SF_6$ and $N_2$ during positive ionization, and wherein the gas is an electron donating gas such as Argon during negative ionization.

33. The method of claim 26, wherein the analyte is labeled with a redoxactive molecule.

34. The method of claim 33, wherein the redoxactive label molecule is an organometallic.

35. The method of claim 26, wherein the analyte is a peptide, peptide, lipid, carbohydrate and any mixture thereof.

36. The method of claim 26, further comprising detecting the oxidized or reduced analyte.

37. The method of claim 36, wherein the detection is carried out with a detector selected from the group consisting of: a mass spectrometer, a gas chromatograph, a high pressure liquid chromatograph, and an ultra high pressure liquid chromatograph.

38. The method of claim 26, wherein the capillary is one of either a micro or nano scale capillary.

* * * * *